US007805206B2

(12) United States Patent
Haaks et al.

(10) Patent No.: US 7,805,206 B2
(45) Date of Patent: Sep. 28, 2010

(54) METHOD FOR INCREASING THE CAPACITY OF AN INSTALLATION USED TO CARRY OUT AN INDUSTRIAL PROCESS

(75) Inventors: Stefan Haaks, Erlangen (DE); Gerd Michaelis, Möhrendorf (DE); Christian-Marius Wegner, Ansbach (DE)

(73) Assignee: Siemens Aktiengesellschaft, Munich (DE)

( * ) Notice: Subject to any disclaimer, the term of this patent is extended or adjusted under 35 U.S.C. 154(b) by 858 days.

(21) Appl. No.: 10/559,866

(22) PCT Filed: Jun. 9, 2004

(86) PCT No.: PCT/EP2004/006258

§ 371 (c)(1),
(2), (4) Date: May 25, 2006

(87) PCT Pub. No.: WO2004/109571

PCT Pub. Date: Dec. 16, 2004

(65) Prior Publication Data

US 2006/0241801 A1 Oct. 26, 2006

(30) Foreign Application Priority Data

Jun. 10, 2003 (DE) ..... 103 26 426

(51) Int. Cl.
*G05B 13/02* (2006.01)

(52) U.S. Cl. ..... 700/33; 700/28; 700/103; 388/804; 60/708

(58) Field of Classification Search ..... 700/19, 700/33, 95, 99, 103, 106, 107, 111, 122, 700/28, 300; 705/8–11, 29; 388/804; 713/300, 713/330, 340; 318/400.08, 400.05; 60/708
See application file for complete search history.

(56) References Cited

U.S. PATENT DOCUMENTS

| | | | | |
|---|---|---|---|---|
| 5,034,897 | A * | 7/1991 | Sainen | 700/140 |
| 5,281,343 | A * | 1/1994 | Lewis et al. | 210/784 |
| 2003/0045962 | A1 * | 3/2003 | Eryurek et al. | 700/128 |

FOREIGN PATENT DOCUMENTS

| | | | |
|---|---|---|---|
| DE | 38 26 097 | A1 | 2/1990 |
| DE | 100 11 607 | A1 | 9/2001 |
| WO | WO 02/29501 | A2 | 4/2002 |

OTHER PUBLICATIONS

Michel Ruel, "Paper Machine Optimization", PAPTAC, Online, Dec. 2001, Montreal, Retrieved from Internet: URL:http://www.topcontrol.com/pdf/papermachineoptimization.pdf, Retrieved on Oct. 8, 2004, pp. 1-3, XP002299971.

Michel Ruel, "Process Optimization", ISA Proceedings 2001, Online, Sep. 19, 2001, Houston, Retrieved from Internet: URL:http://www.topcontrol.com/pdf/processoptimization.pdf>, Retrieved on Oct. 8, 2004, pp. 1-14, XP002299972.

* cited by examiner

*Primary Examiner*—Paul L Rodriguez
*Assistant Examiner*—Sheela Rao

(57) ABSTRACT

The invention relates to a method for increasing the capacity of an installation used to carry out an industrial process in an economical and sustainable manner. Said method consists of the following steps: process variables relevant to the capacity of the installation are determined; said process variables are monitored during variable operating conditions of the installation; and a very small control reserve of the control loops of the installation is established on the basis of the monitored process variables.

9 Claims, 4 Drawing Sheets

METHOD FOR INCREASING THE CAPACITY OF AN INSTALLATION USED TO CARRY OUT AN INDUSTRIAL PROCESS

CROSS REFERENCE TO RELATED APPLICATION

This application is the U.S. National Stage of International Application No. PCT/EP2004/006258, filed Jun. 9, 2004 and claims the benefit thereof. The International Application claims the benefits of German Patent application No. 103 26 426.4 DE filed Jun. 10, 2003, both of the applications are incorporated by reference herein in their entirety.

FIELD OF THE INVENTION

The invention relates to a method for increasing the capacity of an installation used to carry out an industrial process.

BACKGROUND OF THE INVENTION

An increase of a few percentage points in the capacity of an installation for carrying out an industrial process results as a rule in a disproportionately high improvement in profits for the operator of the installation. This type of industrial process can typically be a process with production lines which run through the installation, such as lines for the manufacture of paper, textiles, plastics or metal foils. With such processes the capacity of the process is determined by the speed of the track, e.g. measured in meters per second.

When a machine part for a machine contained in the installation or a complete part of the installation is designed for such an installation, this is mostly done on the basis of similar machines or parts of the installation, taking into account a certain amount of capacity reserve. However, under the operating conditions which actually occur in the installation, the loads imposed on the machine or the parts of the installation are mostly different to those in previously known installations. It is thus not possible to say with any certainty in what way it is possible to increase the capacity of an installation without overloading one or more parts of the installation.

Previous measures for increasing the capacity in such installations, especially in complex installations such as installations for carrying out continuous processes for manufacturing of goods on a production line have also generally lacked long-term sustainability.

SUMMARY OF THE INVENTION

The object of the present invention is therefore to specify a method which allows the capacity of an installation to be increased in a sustained and economical manner.

This object is achieved in accordance with the invention by a method in accordance with the claims. Advantageous embodiments of the method are the object of the subclaim.

The invention in this case is based on the knowledge that previous measures for increasing the capacity in installations has always only been based on considering particular points in the installation and has therefore as a rule ignored long-term sustainability. The determination of the process variables relevant to the capacity of the installation envisaged by the invention and the recording of these variables under changing operating conditions guarantees that all aspects of the influencing factors restricting the capacity of the installation will be taken into consideration. Changing operating conditions here are taken to mean the operating conditions occurring during regular operation of the installation, i.e. in the case of a paper machine the operation of the machine with paper of different qualities and types for example. This avoids looking at only a few specific individual aspects of the installation such as the drive system, under a number of specific operating conditions, but not taking into account other factors and operating conditions which dictate the capacity. As a result this makes not just a short-term increase, but a sustained increase in capacity possible.

The smallest control reserve of the control loops determines the increase in capacity which can be obtained without any further measures. This guarantees that first of all the existing capacity reserves that can be secured are checked and these reserves are secured if necessary. This represents the increase in capacity that can be most easily achieved from the economic standpoint.

If the aim is to use additional measures to obtain an increase in capacity which goes beyond the existing capacity reserve, this can be done by defining a capacity increase target for the installation, determining the necessary control reserves in the control loops for the desired increase in capacity and determining the control loops with a control reserve which is too low for the desired capacity increase.

From the number of control loops with control reserves which are too low it is already evident what effort will be needed for further investigations and possibly also for the implementation of measures for increasing capacity. With a large number of control loops a decision can be taken under some circumstances to define a smaller increase in capacity, so that further investigations are only required for the correspondingly smaller number of control loops.

According to an advantageous embodiment of the invention further steps include a technical and/or technological investigation of the control loops with a control reserve which is too small and formulation of measures for producing the control reserves needed in each case by relieving the load on the relevant control loops and/or by replacing components in the relevant control loops by higher-performance components These measures can finally be evaluated from a technical and or commercial standpoint. On the basis of this evaluation the decision process for the implementation of the improvement measures can be simplified and a solution found which is the optimum solution for the operator of the installation from the cost/benefits standpoint.

Overall the sequence of the above steps ensures that priority is given to dealing with the points for which there is the greatest potential for improvement or for which the cost effectiveness of a conversion is the greatest. At the same time this process allows available capacity reserves to be secured in the most economical way even in a highly-complex installation.

The method in accordance with the invention is especially suitable for increasing the capacity in an installation for executing a continuous process, especially a process for manufacturing goods on production lines, e.g. paper, textiles, plastic or metal foils, for which the capacity is determined by the speed of the production line.

BRIEF DESCRIPTION OF THE DRAWINGS

The invention as well as a further advantageous embodiments of the invention in accordance with the features of the subclaims are explained in more detail below with reference to exemplary embodiments in the figures. The Figures show:

DETAILED DESCRIPTION OF THE INVENTION

Figure 1:
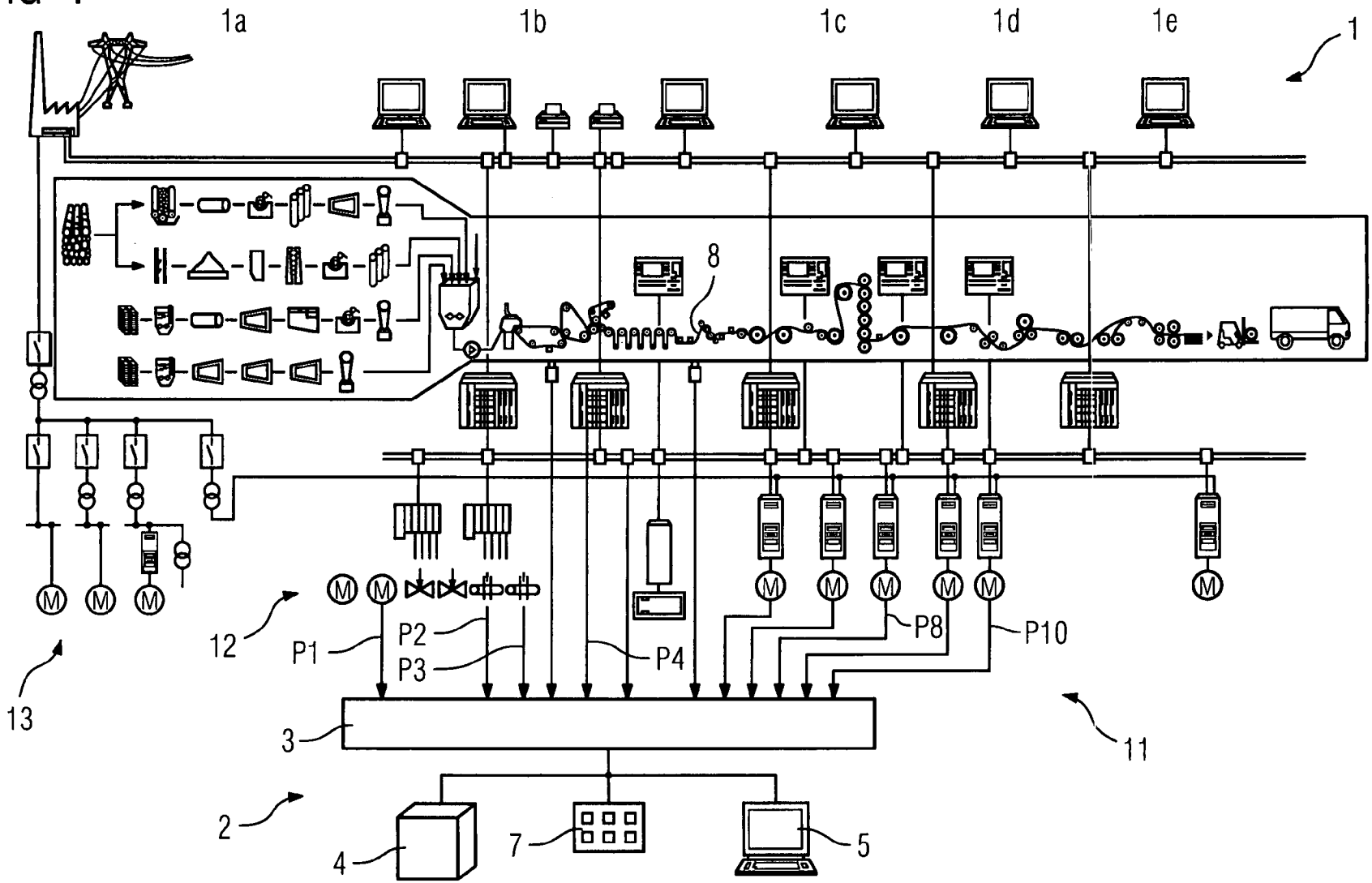
FIG. 1 a recording of process variables in an installation for manufacturing paper, FIG. 2 a representation of an inventive process sequence depicted as a flowchart, FIG. 3 a basic diagram for determining the process variables relevant for the capacity of an installation, FIG. 4 a diagram of the process variables relevant for a paper machine, FIG. 5 a machine velocity/moment diagram for determining the control reserve for a drive motor and FIG. 6 a determination of the control reserve for the drive motor of FIG. 5.

FIG. 1 shows an installation 1 for manufacturing paper. The installation 1 comprises a wide diversity of installation parts which are needed for the different steps in the production process for paper, for example a material preparation system 1*a*, a paper machine 1*b*, a roller/calendar 1*c*, roll cutter 1*d* and cross cutter 1*e*. The paper runs as a production line 8 through major parts of the installation 1.

The installation 1 features a plurality of drive components 11, automation components 12 and energy supply components 13 for driving, supplying power to and controlling the different components in the production process.

A device 2 is used to determine the control reserves in the installation 1. The device 2 features a recording unit 3, an evaluation unit 4, an input unit 7 and an output unit 5.

The recording unit 3 is used for recording process variables P1 . . . P10 of the paper production process on the installation 1. This can for example involve measurement signals which are recorded using signal generators already present and/or to be provided in the installation 1.

The process variables can originate from a wide diversity of sources of the processor and be present in any form, including different forms, e.g. analog, binary, numeric and/or as a changeable physical variable. The evaluation unit 4 is used for determining the control reserves in the control loops of the installation 1. To this end a large number of characteristic capacity curves for a plurality of components, especially standard components occurring in the installation are stored in a memory of the evaluation unit 4. The output unit 5 can be used to present the control reserves for display. Furthermore the device 2 features an input unit 7 for entering a desired capacity increase into the installation 1.

Figure 2:
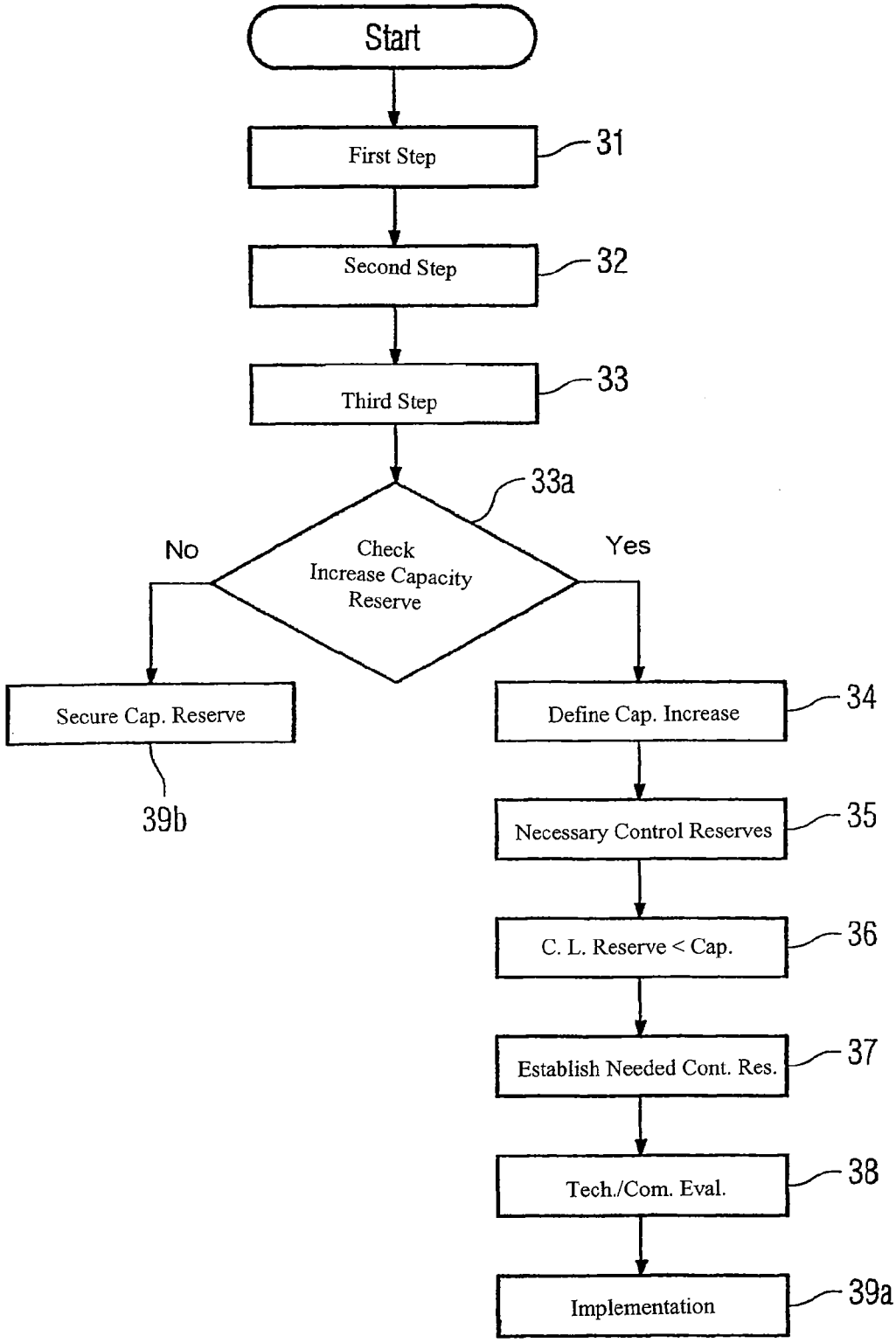

In FIG. 2 the method in accordance with the invention is explained on the basis of a flowchart. The procedure is advantageously carried out by a service provider who has the appropriate know-how and technical facilities to do so.

Figure 3:
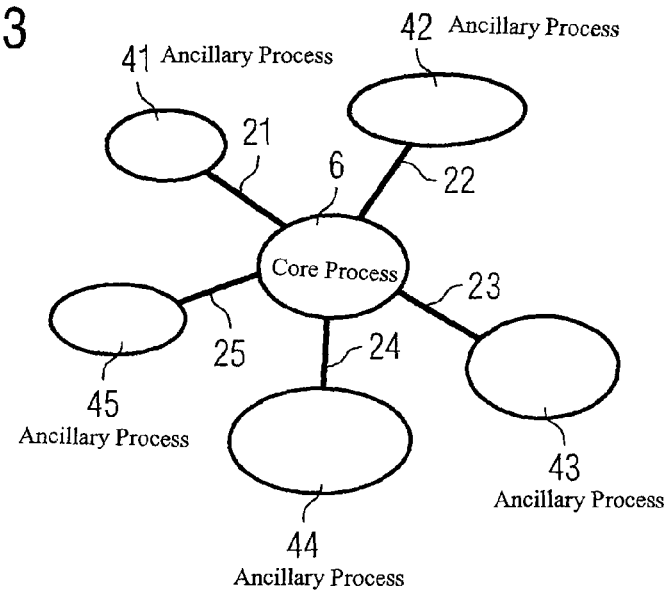
Figure 4:
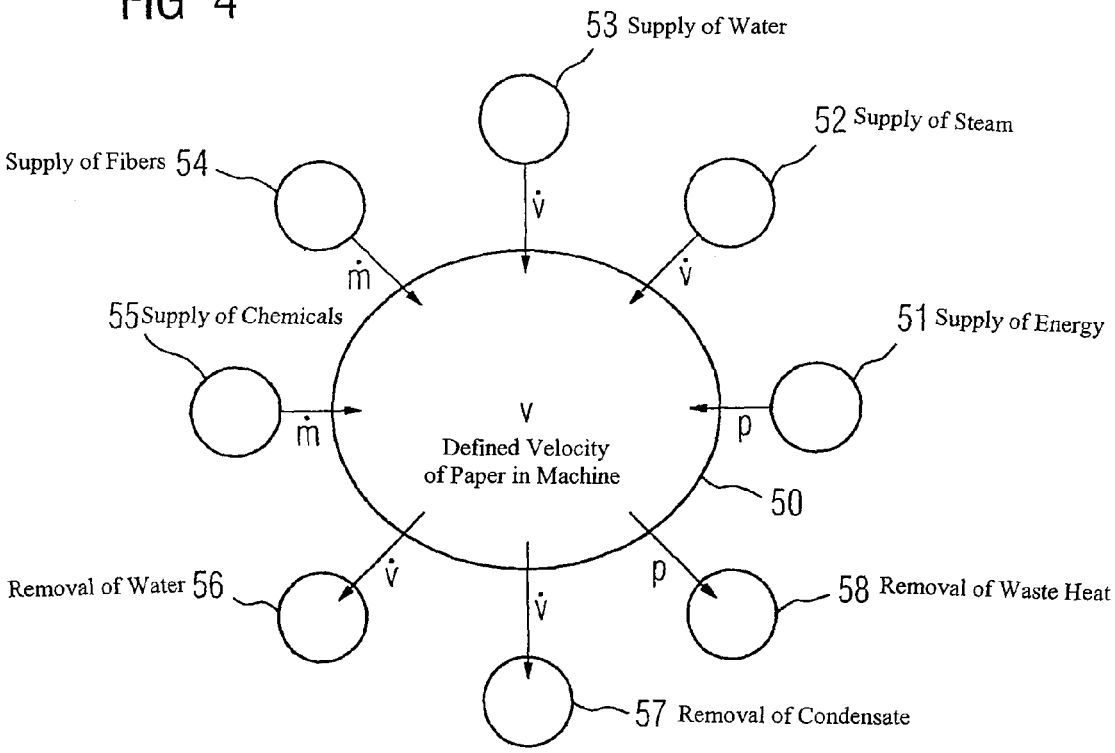

In a first step 31—as explained in detail in FIG. 3 and 4—the process variables relevant for a capacity of the installation are determined. In a second step 32 these process variables are recorded under changing operating conditions of the installation, and in a third step 33—as illustrated by the examples in FIG. 5 and 6—a smallest control reserve of the control loops of the installation is determined on the basis of the recorded process variables. This control reserve can be used to increase the capacity of the installation without any appreciable investment outlay. In a step 33*a* a check is therefore made as to whether an increase in capacity beyond this smallest control reserve is desired. If this is not required, the procedure can be ended in step 39*b*, by securing the available capacity reserve.

If an increase in the capacity of the installation which exceeds the reserve is required, in a further procedural step 34 such a desired capacity increase of the installation can be defined. In a further step 35 the control reserves necessary for the desired increase in capacity are determined in the control loops of the installation and in a further step 36 the control loops with a control reserve which is too small for the desired capacity increase are determined.

For the control loops with a control reserve which is too small, technical and/or technological investigations of the control loops can be performed in a further step 37 to establish the control reserves needed in each case by relieving the load on the relevant control loops and/or through replacing components in the relevant control loops by more powerful components. In a further step 38 a technical and/or commercial evaluation of these measures can be undertaken, on the basis of which a final implementation of the measures is undertaken in step 39*a*.

The process variables relevant for the capacity of an installation can be easily established in this way by applying in the more general sense the method of "cutting free" known per se from technical mechanics.

This is done in a first step by determining a process variable representing the capacity of the installation. In the case of an installation for paper production this might typically be the speed of the paper in the installation In a next step, as basically shown in FIG. 3, a core process 6 of the installation is defined and all interfaces 21-25 of the core process 6 to the ancillary processes 41-45 surrounding it (e.g. ancillary processes for energy, water and compressed air supply) are determined and investigated for their effect in relation to this representational process variable. This can be done by measuring the physical effects (e.g. forces, currents, fields, throughflows, pressures) at these interfaces. These physical effects of process variables can be measured by signal generators already present and/or to be provided, which if necessary must be accommodated at the interfaces.

If there is a effect relationship with the representational process variable at an interface, a process variable which is relevant to the capacity of the installation is present at this interface and a more precise technical investigation is undertaken for the components of the ancillary process to determine the control reserve. The interfaces which do not have an effect relationship are not considered any further and instead the interfaces the interfaces are drawn closer to the core process or moved to within the core process and an investigation is conducted at these new interfaces for an effect relationship with the representational process variable. In this case too interfaces with an effect relationship to the representational process variable are identified as relevant process variables for which in further steps more precise technical investigations for determining the control reserves are to be performed.

Such a systematic, step-by-step "drawing closer" of the interfaces of the ancillary process into the core process ensures that all of the process variables relevant for determining the capacity of the installation are determined, not only in the area of the core process but also in the area of the ancillary processes.

In the case of an installation for paper production the subprocess running on the paper machine can be defined as the core process for example. Interfaces to ancillary processes with effect relationships to the speed of the paper passing through the installation are then to be found in the area of material and energy flows, for example for feeding energy, steam, water, fibers, chemicals and additives as well as for removal of water, condensate and waste heat. The relevant process variables in the area of the ancillary processes are thus in this case—as shown in FIG. 4—the supply of energy 51 (e.g. measured as power P), the supply of steam 52 (measured as volume per unit of time), the supply of water 53 (measured as volume per unit of time) the supply of fibers 54

(measured as mass per unit of time), the supply of chemicals 55 (measured as mass per unit of time) the removal of water 56 (measured as volume per unit of time), the removal of condensate 57 (measured as volume per unit of time) and the removal of waste heat 58 (measured as power P). These relevant process variables can only be recorded under changing operating conditions of the installation, e.g. for different qualities and types of paper, and—as explained below—the control reserves in the control loops of the installation for paper production determined.

Figure 5:
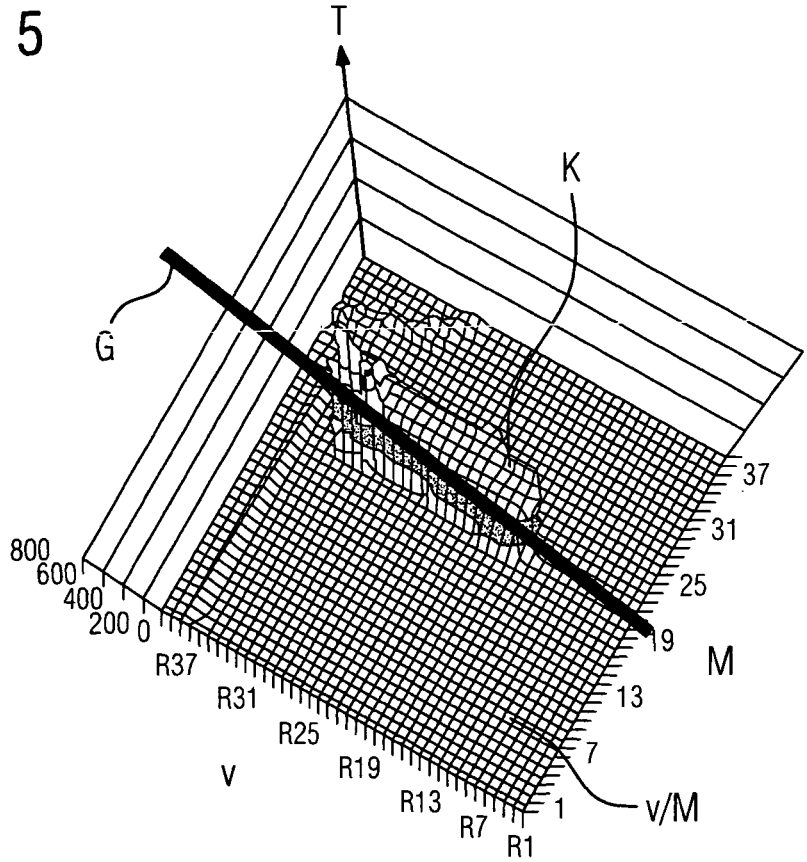

An advantageous procedure for determining the control reserve for an electric motor for driving a paper machine of installation 1 in accordance with FIG. 1 will be explained with the aid of FIG. 5 and FIG. 6. The procedure is basically also applicable to other control loops of the installation (e.g. steam, vacuum, coating).

At a defined velocity v of the paper in the paper machine a defined load (moment) M is present at the electric motor. This operating point defines a specific class K in the speed/load plane v/M shown in FIG. 4. For each class K the time (duration) T is counted in which the motor is operated in this class and shown in a plane perpendicular to the v/M plane. The classes K with the longest times can thus be determined. These can subsequently be approximately described by a linear relationship between moment M and machine velocity v described and represented by a straight line gradient G. Basically the relationship between moment M and machine velocity v can naturally also be described through complex functions.

Figure 6:
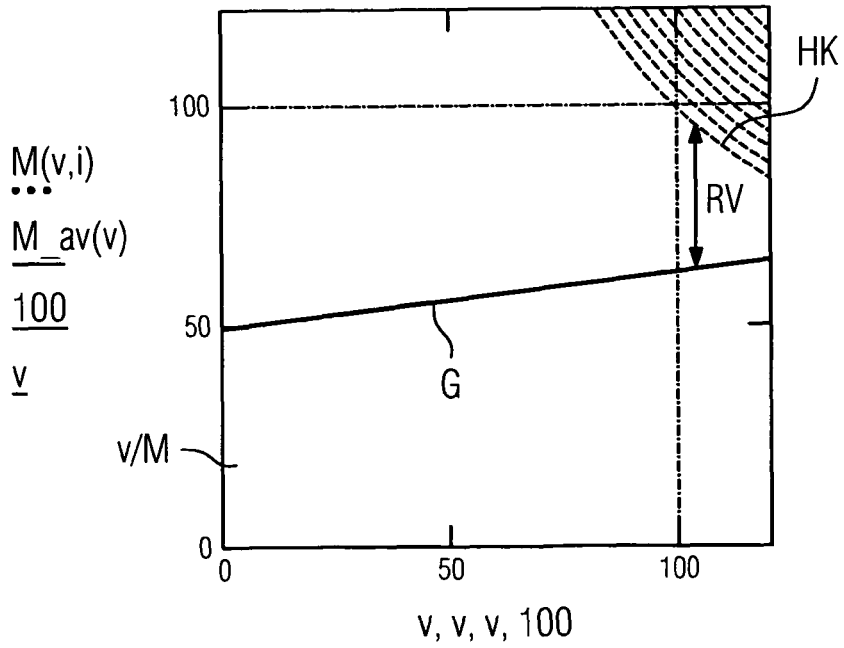

The diagram in FIG. 6 shows the moment M of the motor over the velocity v of the machine, with these two parameters being approximated by a linear relationship in accordance with FIG. 4 represented by the straight line gradient G. With a speed-regulated drive the maximum power of a motor or a converter (depending on which is the smaller) is a hyperbolic curve HK in the velocity/moment plane v/M. The distance RV of this hyperbolic curve HK to the straight line gradient G is a measure for the control reserve and thereby for the maximum possible increase in speed.

In the case of determination of the control reserve for example with regard to the positioning of a vacuum or steam control valve, velocity and load of an ancillary drive, of fluid streams etc. the machine velocity can also be plotted by the position of the valve, the speed of the ancillary drive or the fluid stream instead of via the load, the duration determined and the approximately linear or complex relationship with the velocity v determined.

The processes to be considered in the case of an installation with a continuous production process, e.g. an installation for paper production, are as a rule not very dynamic. The dynamic components in the process variables are not even of primary interest for the determination of the control reserves. Of greater interest instead is the average long-term behavior of the process variables. The process variables are therefore preferably filtered (appr. 2 s) and only sampled appr. every 5 s.

Preferably an online evaluation of the recorded data with subsequent data compression is undertaken for a subsequent offline evaluation of the recorded data.

The invention claimed is:

1. A method that increases a capacity of an installation used to carry out an industrial process, comprising:

determining a plurality of process variables relevant for increasing the capacity of the installation;

recording the process variables during changing operating conditions of the installation;

determining a minimum control reserve of a plurality of control loops of the installation on the basis of the recorded process variables;

determining actions that increase the capacity of the installation, where the determined actions are based on the determined minimum control reserves; and implementing the actions resulting in an increase in installation capacity.

2. The method according to claim 1, further comprising the steps of defining a desired increase in the capacity of the installation, determining the control reserves in the control loops of the installation necessary for the desired capacity increase, and determining the control loops with a control reserve that is too small for the desired capacity increase.

3. The method according to claim 2, further comprising the steps of investigation of the control loops with a control reserve that is too small and formulation of potential actions for producing the control reserves required in each case by relieving the load on the relevant control loops and/or by replacing components in the relevant control loops by higher-capacity components.

4. The method according to claim 3, further comprising the step of performing a technical and/or commercial evaluation of the potential actions.

5. The method according to claim 2, wherein the installation is an installation for execution of a continuous process such as the manufacture of paper, textiles, plastic or metal foils.

6. The method according to claim 5, wherein the capacity of the installation is determined by the speed of production on the production line.

7. The method according to claim 5, wherein the process variables are filtered approximately every 2 seconds and sampled approximately every 5 seconds when they are recorded.

8. The method according to claim 2, wherein the method is executed by a service provider company.

9. The method according to claim 1, wherein a core process being defined for determining the relevant process variables and interfaces of the core process with ancillary processes surrounding them being investigated for an effect relationship with a process variable representing the capacity of the installation.

* * * * *